United States Patent [19]

Heck et al.

[11] Patent Number: 4,671,143

[45] Date of Patent: Jun. 9, 1987

[54] DRIVER JAWS FOR AN AUTOMATIC SCREW FEEDING MACHINE

[76] Inventors: Michael Heck, 302 NE. 36th St., Boca Raton, Fla. 33432; Nathan Singer, 5710 NW. 54th Way, Tamarac, Fla. 33319

[21] Appl. No.: 745,607

[22] Filed: Jun. 17, 1985

[51] Int. Cl.[4] ..... B25B 23/04; B25B 23/10

[52] U.S. Cl. ..... 81/431; 81/452

[58] Field of Search ..... 81/57.37, 125, 431, 81/433, 434, 451, 452, 454

[56] References Cited

U.S. PATENT DOCUMENTS

| | | | |
|---|---|---|---|
| 1,712,196 | 5/1929 | Burger et al. | 81/452 |
| 2,820,494 | 1/1958 | Haberstump | 144/32 |
| 2,922,447 | 1/1960 | Moore | 144/32 |
| 2,932,332 | 4/1960 | Pattison | 81/433 |
| 4,333,367 | 6/1982 | Taffer | 81/430 |
| 4,462,283 | 7/1984 | Ito | 81/57.37 |

FOREIGN PATENT DOCUMENTS

| | | | |
|---|---|---|---|
| 1503072 | 10/1969 | Fed. Rep. of Germany . | |
| 820001 | 9/1959 | United Kingdom | 81/57.37 |
| 1011760 | 12/1965 | United Kingdom | 81/431 |

OTHER PUBLICATIONS

Tru-Tork Brochure, Clyde Eng. & Mfg. Corp.
Pneuma-Serve Brochure, Pneuma Serve, Inc.

*Primary Examiner*—Frederick R. Schmidt
*Assistant Examiner*—Bradley I. Vaught
*Attorney, Agent, or Firm*—Richard M. Saccocio

[57] ABSTRACT

Driver jaws for a driver head of an automatic screw feeding machine are disclosed. A pair of cantilever springs are oppositely disposed on a mandrel or housing. The springs are arranged such that the tips thereof form an opening therethrough which comprises the jaws for holding a fastener during the insertion process. The cantilever springs allow the jaws to open to permit the head of the fastener to pass therethrough after the fastener is fully inserted and to be released from the driver jaws. The cantilever springs permit an exceptionally small clearance spaced around the head of the installed fastener. The tips of the jaws spaced the movable portions of the apparatus away from the work surface so that marring or scratching of the work surface is avoided.

6 Claims, 4 Drawing Figures

DRIVER JAWS FOR AN AUTOMATIC SCREW FEEDING MACHINE

CROSS REFERENCE TO RELATED APPLICATIONS

This invention is related to co-pending patent applications entitled "Escapement Apparatus for an Automatic Screw Feeding Machine" and "Track Feed Arrangement for an Automatic Screw Feeding Machine," by Michael Heck and Nathan Singer.

BACKGROUND OF THE INVENTION

1. Field of the Invention

This invention relates in general to the field of automatic screw feeding machines and in particular to the field of fastener driver apparatus and even more in particular to the jaws of the fastener drive apparatus for an automatic screw feeding machine.

2. Description of the Prior Art

Automatic screw feeding machine is the terminology which is commonly applied to a machine which arranges fasteners, such as screws, from a bulk form into an arrangement whereby the fasteners are aligned and then individually delivered to a driver head. The driver head is then utilized to drive a single fastener within a preexisting hole so as to fasten one component to another. The purpose of such machines is, of course, to speed up production by providing rapid fastening of two or more components. Since speed of production is the main objective of such machines, any portion of the machine which tends to jam or malfunction in any manner results in a work stoppage which is contrary to such main objective. Each operation performed upon a fastener which is being utilized within the machine from its bulk supply disposition to its fastened disposition and any point therebetween must necessarily occur in a serial mode whereby one step follows the other. Any one step, therefore, if it is not accomplished properly, will cause a complete shutdown of the machine and production. In today's modern factories, any production shutdown due to a malfunctioning machine must be avoided at all costs.

Screws or other similar fasteners used in industry are mass produced. Mass production generally involves greater tolerances for a given characteristic such as fastener head height, head diameter, or shank diameter, then corresponding individualized custom machining of screws. Automatic screw feeding machines must accommodate such mass-produced fasteners. The greater tolerances of the mass-produced fasteners thereby imposes relatively difficult individualized tasks on automatic screw feeding machines.

One area where an automatic screw feeding machine of the prior art experiences difficulty is in arranging the screws or other fasteners within the jaws of the driver head such that the shank of the screw or fastener is relatively firmly held by the jaws as well as being perpendicular to the jaws. Perpendicularity is important so that an operator may correctly place the screw where it is intended to be placed and the screw is oriented at the correct angle relative to its placement. A misangled or misaligned screw can cause cross threading in a predrilled and tapped hole which, of course, can lead to inadequate fastening of the parts to be joined by the fastener. Accordingly, new, different, and improved apparatus is desired whereby a fastener is relatively firmly held and is properly aligned with regard to the jaws of an automatic driver of an automatic screw feeding machine.

Another area where the prior art automatic screw feeding machines have experienced difficulty is in being able to insert a fastener in a location where there is a relatively small amount of clearance around the head of a fastener. Typically, in the prior art, a type of jaw arrangement known as clam-shell jaws are frequently used. In this type of jaw arrangement, the jaws comprise two movable or rather pivotable members which are arranged such that the front portion in combination provides a cylindrical opening split along the longitudinal sides thereof. The remote end of the jaws are pivotally attached to a housing or other suitable support member whereby the cylindrical portion of the jaws open in a direction away from each other much in the same manner as a clam would open each half of its shell. When the jaws are sufficiently spaced apart from each other, sufficient clearance exists within the cylindrical opening so that the head of the fastener contained therein may pass therethrough upon exiting the jaws of the machine. Clam-shell jaws required a relatively large amount of clearance space around the head of the fastener as installed so as to allow the jaws to open in the manner before mentioned. As can be imagined, there are many applications whereby fasteners are required to be used and a relatively large clearance space around the head of the fasteners is simply not available. In such instances, either the automatic screw feeding machine cannot be used, or the parts to be joined must be redesigned so as to create sufficient clearance. Accordingly, new, different, and improved jaw apparatus is desired whereby a fastener may be inserted in an area where there is relatively little clearance around the head of the fastener.

Still another area in the prior art where improvement may be advantageously utilized is in prevention of marring or scratching of the surface of the product within which the fastener is to be inserted. The prior art movable jaws, such as the previously-described clam-shell type, in many instances, do mar the surface of the product due to the movement of the jaws. Repeated contact of the removable jaws with the product surface can eventually lead to scratching of the jaws which then can further mar the product. Since automatic screw feeding machines are used for mass production, a significant amount of marring can occur before the extraordinary remedy of shutting down production and repairing the offending jaws. Accordingly, jaw apparatus is desired which substantially reduces actual and potential marring of the surface of the product within which a fastener is inserted.

It is to be noted and especially recognized that there are other objects of the present invention which, although not specifically stated but which objects will be obvious to those skilled in the art to which this invention pertains, are intended to be included within the scope of the present invention.

SUMMARY OF THE INVENTION

The present invention accomplishes the abovestated objects, in addition to others, by providing cantilevered spring jaw apparatus for the driver head of an automatic screw feeding machine.

A jaw mandrel is attached to the extending shaft of the driver head of an automatic screw feeding machine. A pair of oppositely-arranged cantilever springs are attached to opposite sides of the jaw mandrel. A spring yoke is used to attach the cantilever springs to a jaw mandrel. A fastener is pneumatically driven through a port in the jaw mandrel to a location within a containment created by a combination of the cantilever springs and the sides of the mandrel. The containment thereby created uniquely forms a structure which allows for firm holding and perpendicular alignment of the fastener therewithin. Upon inserting the fastener and discharging of the same from the jaws, the opening of the cantilever springs requires a space only slightly greater than the diameter of the head of the fastener. By extending the sides of the mandrel beyond the tips of the cantilever jaws, the components to be joined by the automatic screw feeding machine is protected from the potential marring action of movable parts.

Various other objects, advantages, and features of the invention will become apparent to those skilled in the art from the following discussion taken in conjunction with the following drawings, in which:

DESCRIPTION OF THE PREFERRED EMBODIMENTS

Figure 1:
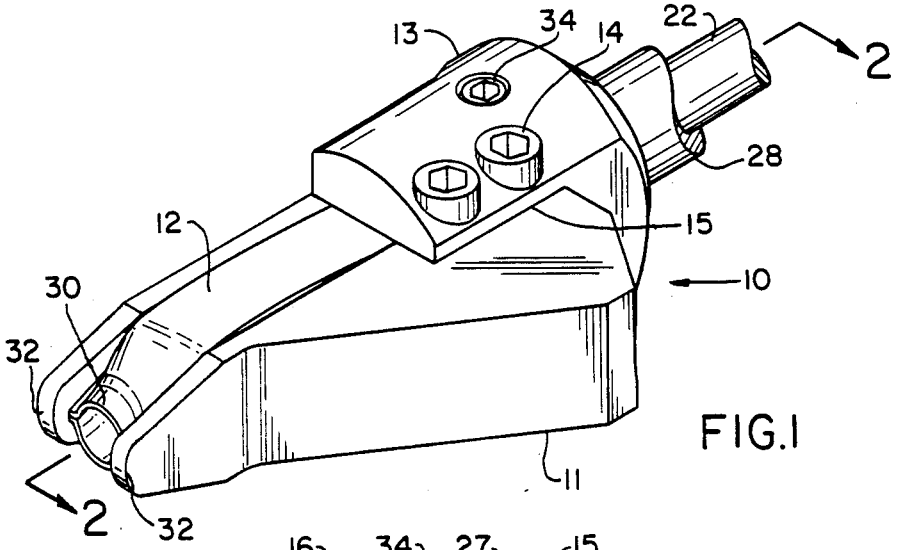
FIG. 1 is an isometric view of one embodiment of the inventive jaws of an automatic screw feeding machine.

Reference is now made to the drawings where like characteristics and features of the various figures are denoted by like reference characters.

Figure 2A:
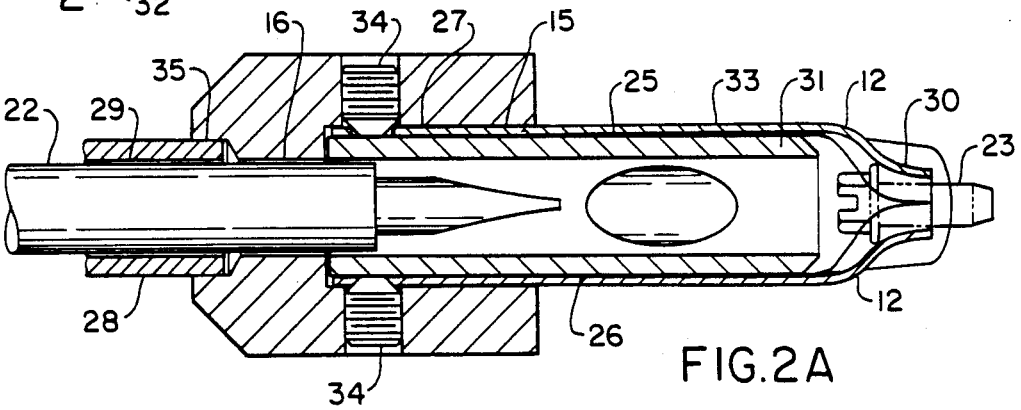
FIGS. 2A and 2B are a side elevation, partly in cross section, of the inventive jaws illustrating the sequence of operation of the inventive jaws; and, FIG. 3 is an isometric view of the mandrel portion of the inventive jaw apparatus.
Figure 2B:
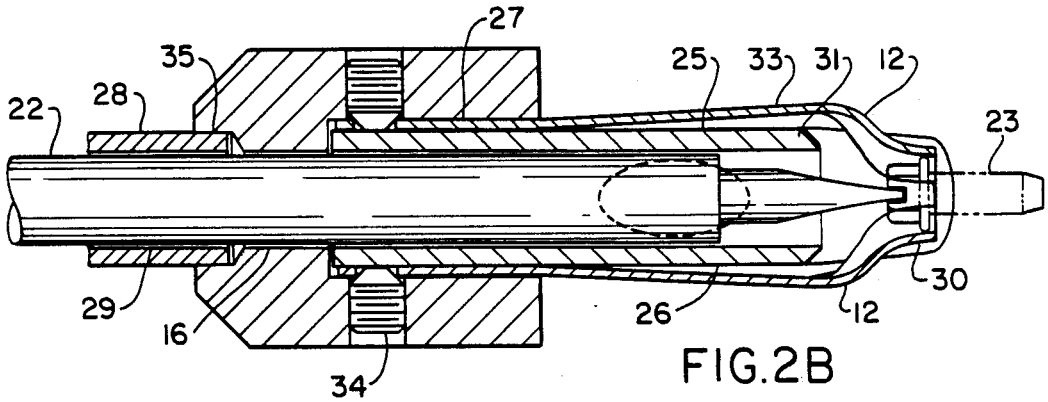
Figure 3:
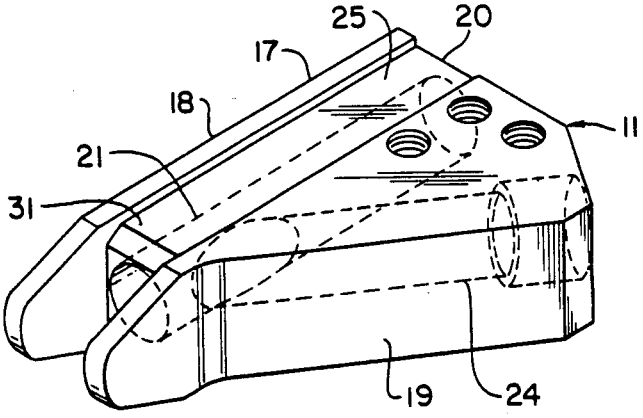

The inventive jaw apparatus 10 shown in FIG. 1 comprises mandrel, cantilever springs 12, and a spring yoke 18. Referring also to FIGS. 2A and 2B, mandrel 11 is attached to spring yoke 13 by means of screws 14. Spring yoke 13 comprises a generally cylindrical member having a cutout portion 15 in one end thereof and the through hole 16 in the other end thereof. The remote end 17 of mandrel 11 fits within cutout 15 and is attached thereto by the aforementioned screws 14. Mandrel 11, as shown in FIG. 3, may be machined from a single block of material. A side portion 18 comprises an elongated, flat, relatively thin member. The side opposite member 18 comprises a combination wall member and a fastener delivery housing 19. Wall member 18 in combination with member 19 are separated by a bar member 20 having a substantially square cross-sectional shape. A hole 21 is provided within and completely through bar member 20 in a direction substantially parallel to the longitudinal axis of wall member 18. Hole 21 is provided to promote the passage therethrough of the shaft of fastener drive member 22.

Fastener driver is shown in phantom in FIGS. 2A and 2B. Fastener driver 22 is conventionally known in the art, and, for example, may comprise a bar having an end associated therewith such as a screw driver tip or a socket drive tip. The driver end of fastener driver 22, of course, mates with and drives fastener 23. Another through hole 24 is provided within mandrel 11 as shown in FIG. 3. An appropriate, flexible conduit (not shown) is attached to the entrance of through hole 24 and serves the purpose of delivering a fastener 23 to the interior of mandrel 11. As can be seen in FIGS. 2A and 2B, a fastener 23 upon being ducted through hole 24 is urged toward and through the front end of hole 21 through mandrel 11. Fastener 23 will ultimately be further urged toward the jaws comprising cantilever springs 12 as will be more fully explained hereinafter. The upper and lower surfaces 25 and 26, of bar member 20 are slightly depressed relative to the edges of upper and lower surfaces of of wall member 18 and combination member 19. The depression or undercut thereby provided, allows placement therein of cantilever springs 12. In this manner, the remote ends 27 of cantilever springs 12 fit substantially flush with the upper and lower surfaces of wall member 18 and combination member 19 as shown more clearly in FIGS. 2A and 2B. Screws 34 serve to retain cantilever springs 12 within yoke 13 and against the upper and lower surfaces 25 and 26 of bar member 20.

The front end of the driver housing 28 fits within hole 35 of the other end of spring yoke 13. The portion of driver housing 28, shown in the various figures of the drawings, is hollow so as to permit the fastener driver 22 to fit therethrough. Driver housing 28 may be fitted to spring yoke 13 in any conventional manner, such as by force fit within hole 35 or by welding. The opening 29 through driver housing 28 is co-axially aligned with the opening or hole 21 through bar member 20 of mandrel 11 such that the fastener driver 22 may be received within both members.

Cantilever springs 12 each comprise an elongated strip of spring steel having a substantially flat shape at end 27 and a semicylindrical shape at end 30. Ends 30 of springs 12, when springs 12 are assembled to mandrel 11, form a substantially cylindrical shape having an inner diameter which is slightly larger than the shank diameter of the fasteners 23 which will be utilized with the inventive jaw apparatus 10. Accordingly, ends 30 of springs 12 are somewhat neck down or tapered down relative to ends 27 thereof. The configuration of springs 12 is shown in the unloaded or free stage in FIG. 2A of the drawings. As can be seen, the flat portion of springs 12 lay against surfaces 25 and 26 of bar portion 20 of mandrel 11 for substantially the full length of bar portion 20. Springs 12 are slightly raised from end 31 of bar portion or member 20. The slightly raised position is due to the transition of springs 12 from the flat portion 27 to the semicylindrical portion 30. In other words, the side edges of springs 12 are in contact with the end 31 of bar portion 20 of mandrel 11. Ends 32 of wall members 18 and 19 extend slightly beyond the ends 30 of spring members 12. In this manner, ends 30, which are movable in accordance with the operation of springs 12, never come in contact with the work surface or product within which fasteners 23 are to be inserted.

In operation, a fastener 23 is delivered to jaw apparatus 10 through hole 24 in mandrel 11. Usually, a positive air pressure is utilized to deliver the screw in this fashion. The angle of the opening 24 in mandrel 11 causes screw 23 to be urged forward toward the tips 30 of springs 12. At this point in the sequence of operation, fastener driver 22, or rather the driver end thereof, is at a position upstream of opening 24 as it exits through wall 19. In this manner, fastener 23 has an unobstructed path in being urged toward ends 30 of springs 12. Since fasteners 23 are always delivered with the shank end forward, the shank end is urged through the cylindrical opening created by ends 30 of springs 12. The forward travel of fastener 23 is stopped when the head portion comes in contact with the opening through ends 30. Accordingly, the size of the opening through ends 30 is slightly smaller than the effective cross-sectional diameter of the head of fastener 23.

Driver 22 immediately engages with the driver head of fastener 23 as soon as fastener has been delivered to the opening created by ends 30 of springs 12. The combination of the force imposed by driver 22 and the spring tension exerted by springs 20, due to the contact of the head of fastener 23 with the inside of ends 30 of such springs, results in fastener 23 being substantially perpendicularly oriented relative to the plane of the work surface or substantially parallel to the longitudinal axis of the openings through jaw apparatus 10. Additionally, as previously stated, since the openings created by ends 30 of springs 12 are only slightly larger than the shank diameter of fastener 23, there is little ability for fastener 23 to become misaligned relative to the longitudinal axis of jaw apparatus 10. It is to be noted that the end of shank portion of fastener 23 extends beyond the ends 31 of walls 18 and 19. Such extension is, of course, necessary to allow fastener 23 to be properly positioned relative to the work product.

Upon rotation of driver 22 which is in engagement with the head of fastener 23, fastener 23 is being driven into the work product. Such advancement causes fastener 23 to be pulled through the opening created by ends 30 of springs 12 which becomes slightly larger so as to accommodate the effective cross-sectional diameter of the head of fastener 23. The advent of the orientation in positioning of springs 12 allows such motion of fastener 23. Since ends 30 of springs 12 open relative to the previous sequence of operation, springs 12 are caused to flex in a cantilever fashion in accordance with the support provided at end 27 and by screws 34. This position is reflected in FIG. 2B of the drawings. The increase in space between end 31 of bar member 20 and the somewhat central portion 33 can be seen by comparing FIGS. 2A and 2B. This increase in distance of portion 33 is substantially equal to the increase between the radius of the cylindrical opening through spring ends 30 in the free stage as compared to the loaded stage sequentially shown in FIGS. 2A and 2B, respectively. However, since ends 30 converge relatively to central portion 33 of springs 12, and due to the cantilever action of springs 12, the effective outside diameter of ends 30 substantially comprise a diameter of a head of fastener 23 plus twice the thickness of the material from which spring 12 is made. However, it is to be noted that the effective outside cross-sectional diameter of ends 30 when fastener 23 is being passed therethrough, substantially coincides with the length or height of ends 32 of walls 18 and 19 of mandrel 11. Since ends 32 and ends 30 are only slightly larger than the diameter of the heads of fasteners 23, the inventive jaw apparatus 10 may be utilized to insert a fastener 23 at a location having relatively little clearance around the installed head of fastener 23. And, as previously mentioned above, since a nonmoving end, that is, end 32 of walls 18 and 19, and not movable ends 30 of springs 12, come in contact with the work product, any marring or scratching of the surface of the work product is minimized. In the manner shown and described, the inventive jaw apparatus utilizes cantilever springs 12 to serve as the movable jaws of an automatic screw feeding machine.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

We claim as our invention:

1. Jaw apparatus adapted to be fitted to a driver head of an automatic screw feeding machine for holding a fastener during the insertion of the fastener by the driver of the automatic screw feeding machine, comprising, a mandrel attached at one end to said driver head, said mandrel comprising a pair of wall members oppositely disposed and separated by an elongated substantially rectangular member having an axial opening therethrough, spring means attached to said mandrel for holding said fastener during the insertion thereof and for releasing said fastener upon completion of the insertion, said spring means comprising a pair of cantilever springs fitting against opposite sides of said rectangular member and between said wall members, the unsupported ends of said springs extending from said driver head and being formed so as to create a substantially circular opening at the end thereof, said wall members extending beyond the circular opening created by the formed ends of said springs, said formed ends converging toward each other such that said opening created thereby is slightly larger than the shank of said fasteners, said formed ends being operable to align said screw fastener relative to the angle of insertion and to permit the head of said fasteners to pass therethrough upon bending of said springs during release of individual fasteners from said automatic screw feeding machine.

2. The jaw apparatus of claim 1, wherein said mandrel includes a pair of wall members oppositely disposed and separated by an elongated substantially rectangular member having an axial opening therethrough, said springs fitting against opposite sides of said rectangular member and between said wall members.

3. The jaw apparatus of claim 1, wherein one wall member includes an opening therethrough positioned at an acute angle to said opening through said elongated rectangular member for ducting a fastener inside the opening in said rectangular member and through said opening formed by said springs.

4. The apparatus of claim 1, wherein said wall members and said rectangular member are integral with each other.

5. The apparatus of claim 1, wherein each of said wall members, at the end extending beyond said springs, terminate in a smoothly curved configuration.

6. The apparatus of claim 5, wherein said end of each of said wall members include a diverging tapered portion between said curved end and the remaining portion of said wall members.

* * * * *